US006750602B2

(12) United States Patent
Hirota et al.

(10) Patent No.: US 6,750,602 B2
(45) Date of Patent: Jun. 15, 2004

(54) PROJECTION TYPE CATHODE RAY TUBE DEVICE EMPLOYING A CATHODE RAY TUBE HAVING A NECK COMPOSED OF DIFFERENT-DIAMETER PORTIONS

(75) Inventors: Katsumi Hirota, Chiba (JP); Kotaro Aoki, Mobara (JP); Kazumasa Hirai, Mobara (JP); Takashi Hoshimure, Mobara (JP)

(73) Assignee: Hitachi Ltd., Tokyo (JP)

( * ) Notice: Subject to any disclaimer, the term of this patent is extended or adjusted under 35 U.S.C. 154(b) by 0 days.

(21) Appl. No.: 10/211,652

(22) Filed: Aug. 2, 2002

(65) Prior Publication Data

US 2003/0030361 A1 Feb. 13, 2003

(30) Foreign Application Priority Data

Aug. 9, 2001 (JP) ..... 2001-241514

(51) Int. Cl.[7] ..... H01J 29/70

(52) U.S. Cl. ..... 313/477 R; 313/482; 313/441; 313/440; 335/284; 335/296; 335/209

(58) Field of Search ..... 313/477 R, 440, 313/441, 482; 335/284, 296, 209

(56) References Cited

U.S. PATENT DOCUMENTS

| | | | | |
|---|---|---|---|---|
| 2,250,662 A | | 7/1941 | Bowie | |
| 3,163,794 A | * | 12/1964 | Bloomsburgh et al. | 313/427 |
| 4,143,298 A | | 3/1979 | Bing et al. | |
| 4,409,515 A | * | 10/1983 | Kloss | 313/477 R |
| 4,961,021 A | * | 10/1990 | Oguro et al. | 313/412 |
| 5,777,430 A | | 7/1998 | Ueda et al. | |
| 5,909,079 A | | 6/1999 | Uchida et al. | |
| 5,994,830 A | | 11/1999 | Nose et al. | |
| 6,031,326 A | | 2/2000 | Suzuki et al. | |
| 6,133,685 A | | 10/2000 | Konda et al. | |
| 6,271,625 B1 | | 8/2001 | Van Engelshoven et al. | |
| 6,337,546 B1 | * | 1/2002 | Inoue | 315/410 |
| 6,404,119 B1 | * | 6/2002 | Hidaka et al. | 313/477 R |
| 6,441,547 B1 | * | 8/2002 | Van Alphen et al. | 313/477 R |
| 2002/0180335 A1 | * | 12/2002 | Saitou et al. | 313/477 R |

FOREIGN PATENT DOCUMENTS

| | | |
|---|---|---|
| EP | 0 250 027 A1 | 12/1997 |
| JP | 11135037 | 6/1983 |
| JP | 59100344 | 6/1983 |
| JP | 03-192636 A | 8/1991 |
| JP | 11-185660 A | 7/1999 |

OTHER PUBLICATIONS

J. Kilton; 52.4 : A 16–cm Large Neck Projection CRT for HDTV; SID 1999 Digest. p. 1084–1087.
EP 011 11 6755 Communication, European Search Report, Oct. 9, 2002, Examiner J. Meyer, 4 pages.

* cited by examiner

*Primary Examiner*—Nimeshkumar D. Patel
*Assistant Examiner*—Holly Harper
(74) *Attorney, Agent, or Firm*—Milbank, Tweed, Hadley & McCloy LLP

(57) ABSTRACT

A projection type cathode ray tube device includes a panel, a neck, a funnel connecting the panel to one end of the neck, and a stem closing the other end of the neck. An electron gun is housed in the neck for projecting an electron beam toward a phosphor screen on the panel. The neck includes a small-diameter neck portion disposed on its funnel side, a large-diameter neck portion disposed on its stem side, and a neck junction region connecting the small-diameter neck portion and the large-diameter neck portion. A deflection yoke is disposed in a vicinity of a transition region between the funnel and the small-diameter neck portion. A convergence yoke for generating a beam-convergence magnetic field is disposed to extend from the large-diameter neck portion and surround at least a portion of the neck junction region.

10 Claims, 10 Drawing Sheets

FIG. 11

| PRTs | DISTORTIONS OF RASTERS PROJECTED ON SCREEN SRN | CONVERGENCE - YOKE CURRENT WAVEFORMS |
|---|---|---|
| rPRT, gPRT, bPRT | PINCUSHION | VERT. COIL: PARABOLIC<br>HORIZ. COIL: SAWTOOTH |
| rPRT, bPRT | KEYSTONE | SAWTOOTH |
| | NON - LINEAR | PARABOLIC |

PROJECTION TYPE CATHODE RAY TUBE DEVICE EMPLOYING A CATHODE RAY TUBE HAVING A NECK COMPOSED OF DIFFERENT-DIAMETER PORTIONS

BACKGROUND OF THE INVENTION

The present invention relates to a projection type cathode ray tube device used for a projection type image display device such as a projection TV receiver and a video projector.

The projection type image display device incorporates three projection type cathode ray tube devices for producing red, green and blue images, respectively. The three images on the projection type cathode ray tube devices are enlarged by a projection lens and are combined on a screen.

Each of the projection type cathode ray tube devices incorporates a deflection yoke, a convergence yoke, and an alignment magnet arranged in the order from a phosphor screen toward an electron gun. An electron beam projected from the electron gun is deflected by a deflection magnetic field generated by the deflection magnetic field, and then reaches the phosphor screen.

Distortions of the rasters and size differences between the three color rasters (called color misregistration or misconvergence) projected on a viewing screen are corrected by magnetic fields generated by convergence yokes. In the projection type image display device, three images projected from the three projection type cathode ray tubes need to be made coincident on the viewing screen, and therefore a convergence yoke needs to be employed to obtain images free from color misregistration. Such a conventional technique is disclosed in Japanese Patent Application Laid-Open No. Hei 8-287845, for example.

SUMMARY OF THE INVENTION

Recently, projection type cathode ray tubes having a neck composed of different-diameter portions (hereinafter projection type CRTs of the different-diameter multiple neck type) have been developed which makes an outside diameter of a deflection-yoke-mounting portion smaller than that of a portion housing an electron gun, for the purpose of achieving the reduction of a deflection power consumption and the improvement of focusing characteristics at the same time.

In the projection type CRTs of the different-diameter multiple neck type, when a convergence yoke for correcting the above-mentioned color misregistration is mounted around the portion of the neck having the smaller outside diameter (the small-diameter neck portion), the sensitivity of correction of color misregistration on the viewing screen of the projection type image display device is improved because the inside diameter of the convergence yoke itself is reduced. In this case, however, since it is necessary to increase the axial length of the small-diameter neck portion for providing the space for mounting both the deflection yoke and the convergence yoke, a main lens of the electron gun housed within the portion of the neck having the larger outside diameter (the large-diameter neck portion) is moved farther from a phosphor screen, and therefore focus characteristics on the phosphor screen is degraded. Moreover, when the axial length of the small-diameter neck portion is increased, the overall length of the projection type cathode ray tube itself is increased, and it is not desirable for realizing a compact projection type image display device.

Under these circumstances, in the projection type CRTs of the different-diameter multiple neck type, it is inevitable to mount the convergence yoke around the large-diameter neck portion, and therefore it has been a problem of improving the sensitivity of correction of color misregistration.

A representative purpose of the present invention is to provide a projection type cathode ray tube device employing a projection type CRT of the different-diameter multiple neck type having improved focus characteristics of an image display and improved efficiency of correction of color misregistration.

A representative configuration of the present invention is such that, in the projection type CRTs of the different-diameter multiple neck type, a convergence yoke is disposed to extend from the large-diameter neck portion to the transition region between the large-diameter and small-diameter neck portions.

Since projection type cathode ray tubes employ a single-color phosphor screen and a single-beam electron gun, they have larger space between the electron beam and the inner wall of the neck of their vacuum envelope than color cathode ray tubes employing a three-color phosphor screen and a three-beam electron gun, and therefore, in the projection type cathode ray tubes, there is not much possibility that the electron beams strike the inner wall of the neck. In view of this, in the projection type CRTs of the different-diameter multiple neck type, a difference between the large-diameter and small-diameter neck portions are made as large as possible to realize reduction of deflection power consumption and improvement of focus characteristics effectively.

On the other hand, the diameter of the neck varies gradually along the axis of the neck in the neck junction region between the large-diameter and small-diameter portions, and therefore the axial length of the neck junction region is increased as the difference between the large-diameter and small-diameter neck portions is increased. Space around the neck junction region has not been used effectively. The above-mentioned representative configuration of the present invention uses the otherwise unused neck junction region as space for mounting the convergence yoke effectively, thereby increases the axial length of the convergence, and increases the efficiency of correction of color misregistration without mounting the convergence yoke around the small-diameter neck portion intentionally.

In accordance with an embodiment of the present invention, there is provided a projection type cathode ray tube device comprising: a glass envelope including a panel, a neck, a funnel connecting the panel to an end of the neck, and a stem closing another end of the neck; a phosphor screen formed on an inner surface of the panel; an electron gun housed in the neck for projecting an electron beam toward the phosphor screen; a deflection yoke for scanning the electron beam on the phosphor screen; and a convergence yoke for generating a beam-convergence magnetic field, wherein the neck comprises a small-diameter neck portion disposed on a side thereof facing toward the funnel, a large-diameter neck portion disposed on a side thereof facing toward the stem, and a neck junction region connecting the small-diameter neck portion and the large-diameter neck portion; the deflection yoke is disposed in a vicinity of a transition region between the funnel and the small-diameter neck portion, and the convergence yoke is disposed to extend from the large-diameter neck portion and surround at least a portion of the neck junction region.

In accordance with another embodiment of the present invention, there is provided a projection type cathode ray tube device comprising: a glass envelope including a panel, a neck, a funnel connecting the panel to an end of the neck, and a stem closing another end of the neck; a phosphor screen formed on an inner surface of the panel; an electron gun housed in the neck for projecting and focusing an electron beam onto the phosphor screen; a deflection yoke for scanning the electron beam on the phosphor screen two-dimensionally; and a convergence yoke for generating a beam-convergence magnetic field, wherein the neck comprises a small-diameter neck portion disposed on a side thereof facing toward the funnel, a large-diameter neck portion disposed on a side thereof facing toward the stem, and a neck junction region connecting the small-diameter neck portion and the large-diameter neck portion; the deflection yoke is disposed in a vicinity of a transition region between the funnel and the small-diameter neck portion, the convergence yoke is disposed around the neck junction region, and an inside diameter at a phosphor-screen-side end of the convergence yoke is smaller than an outside diameter of the large-diameter neck portion.

In accordance with another embodiment of the present invention, there is provided a projection type cathode ray tube device comprising: a glass envelope including a panel, a neck, a funnel connecting the panel to an end of the neck, and a stem closing another end of the neck; a phosphor screen formed on an inner surface of the panel; an electron gun housed in the neck for projecting an electron beam toward the phosphor screen; a deflection yoke for scanning the electron beam on the phosphor screen; and a convergence yoke for generating a beam-convergence magnetic field, wherein the neck comprises a small-diameter neck portion disposed on a side thereof facing toward the funnel, a large-diameter neck portion disposed on a side thereof facing toward the stem, and a neck junction region connecting the small-diameter neck portion and the large-diameter neck portion; the deflection yoke is disposed in a vicinity of a transition region between the funnel and the small-diameter neck portion, and the convergence yoke is disposed around the small-diameter neck portion.

In accordance with another embodiment of the present invention, there is provided a projection type cathode ray tube device comprising: a glass envelope including a panel, a neck, a funnel connecting the panel to an end of the neck, and a stem closing another end of the neck; a phosphor screen formed on an inner surface of the panel; an electron gun housed in the neck for projecting an electron beam toward the phosphor screen; a deflection yoke for scanning the electron beam on the phosphor screen; and a convergence yoke for generating a beam-convergence magnetic field, wherein the neck comprises a large-diameter neck portion disposed on a side thereof facing toward the stem, and a neck junction region having an outside diameter thereof decreasing toward the funnel, one end of the neck junction region being connected to the large-diameter neck portion, and another end of the neck junction region being connected to the funnel, the deflection yoke is disposed in a vicinity of a transition region between the funnel and the neck junction region, and the convergence yoke is disposed to extend from the large-diameter neck portion and surround at least a portion of the neck junction region.

BRIEF DESCRIPTION OF THE DRAWINGS

In the accompanying drawings, in which like reference numerals designate similar components throughout the figures, and in which:

FIG. 11 illustrates some examples of currents supplied to convergence yokes to correct distortions of rasters projected on a screen by three projection type cathode ray tube devices.

DETAILED DESCRIPTION OF THE PREFERRED EMBODIMENTS

Representative embodiments in accordance with the present invention will now be explained in detail by reference to the drawings.

Figure 1:
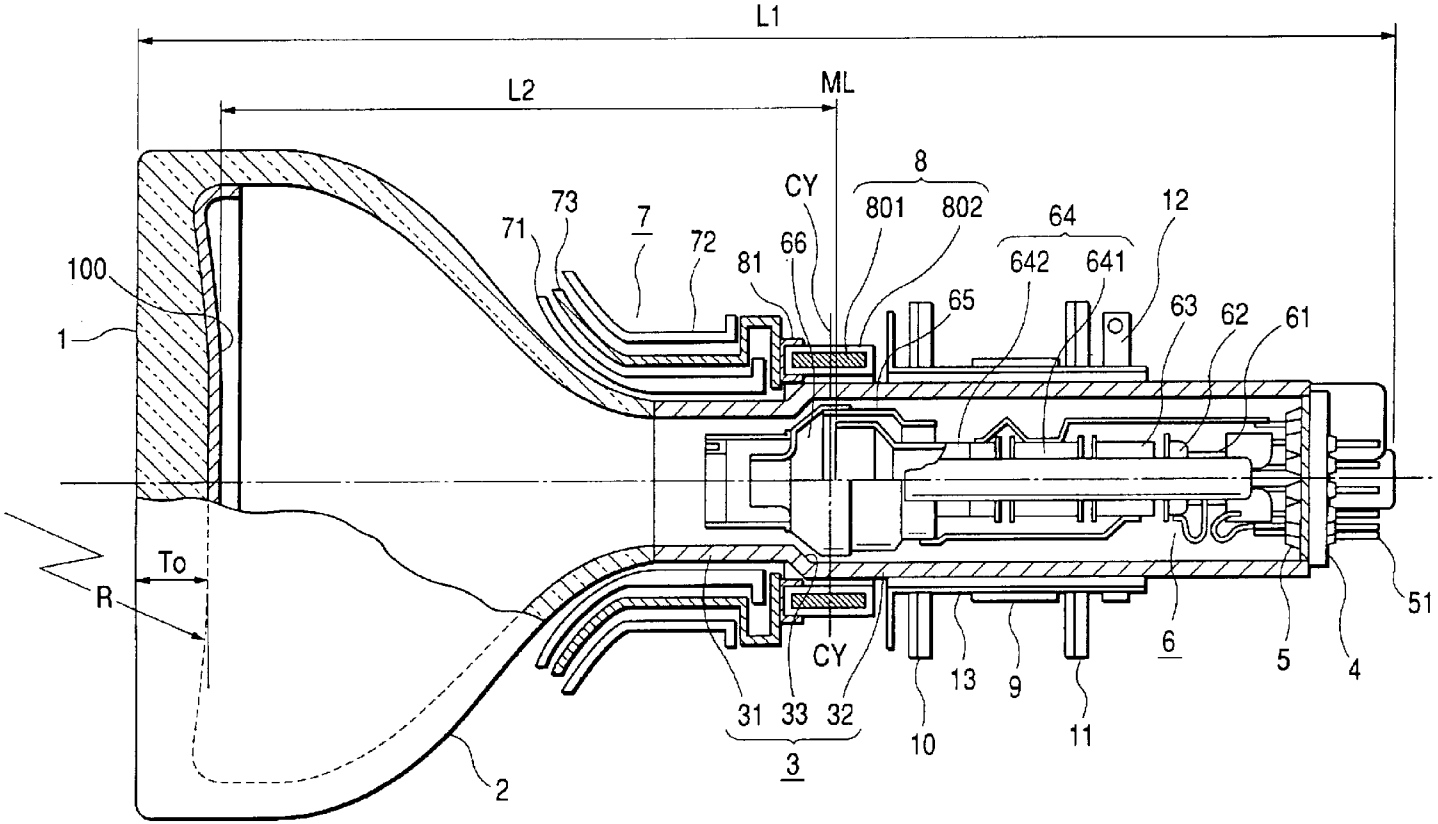
FIG. 1 is a schematic side view, partly cut away and partly in section of a first embodiment of a projection type cathode ray tube device in accordance with the present invention.

FIG. 1 is a schematic side view, partly cut away and partly in section of a first embodiment of the projection type cathode ray tube device (hereinafter PRT) in accordance with the present invention. The PRT is used for a projection type television receiver and the like. A vacuum envelope of the PRT is composed of a panel 1, a neck 3, a funnel 2 connected to one end of the neck 3, and a stem 5 closing the other end of the neck 3. The stem 5 has pins 51 embedded therein for supplying voltages to respective electrodes of an electron gun 6. A base 4 serves to protect the stem 5 and the pins 51. The PRT is provided with a generally rectangular single-color phosphor screen formed on an inner surface of the generally rectangular panel 1. A single beam is projected from the electron gun 6, then is deflected horizontally and vertically by a deflection yoke 7, and then scans the phosphor screen to generate light.

The panel 1 has a flat outer surface and an inner surface convex toward the electron gun 6 which forms a convex lens. In this embodiment, the inner surface of the panel 1 is spherical with a radius R of curvature of 350 mm. The inner surface of the panel 1 is sometimes made aspherical to compensate for aberration due to a projection lens. The glass thickness To of the panel 1 is 14.1 mm at the center of the panel 1, the external diagonal dimension of the panel 1 is 7 inches, the diagonal dimension of the usable viewing screen area formed with the phosphor screen is 5.5 inches, and the overall length L1 of the PRT is 276 mm.

The neck 3 comprises a small-diameter neck portion 31 connected to the funnel 2, a large-diameter neck portion 32 sealed with the stem 5, and a neck junction region 33 connecting the small-diameter neck portion 31 and the large-diameter portion 32 together. The deflection yoke 7 is mounted around the outside of the transition region between the small-diameter neck portion 31 and the funnel 2. The small-diameter neck portion 31 is 29.1 mm in outside diameter. The electron gun 6 is housed within the large-diameter neck portion 32. The outside diameter of the large-diameter portion 32 is 36.5 mm, and is considerably larger than that of the small-diameter neck portion 31. In this specification, such a PRT having a neck composed of different-diameter portions will be called a PRT of the different-diameter multiple neck type. Here the outside neck diameters 29.1 mm and 36.5 mm are nominal values assigned for the purpose of convenient designation, and the actual outside diameters vary from the nominal values due to manufacturing tolerances.

In this way, a horizontal deflection coil 71 and a vertical deflection coil 72 of the deflection yoke 7 for deflecting the electron beam are mounted around the small-diameter neck portion 31, and thereby the deflection power consumption can be reduced. In this case, the deflection power consumption is reduced by about 25% compared with that in the case of the outside neck diameter of 36.5 mm. Electrodes for forming a main lens of the electron gun 6 for focusing the electron beam are housed within the large-diameter neck portion 32, and thereby the diameter of the electron lens can be increased.

The first grid electrode (the control electrode) 61 of the electron gun 6 is formed in the shape of a cup, and a cathode for emitting the electron beam is housed within the first grid electrode 61. The second grid electrode (the accelerating electrode) 62 forms a prefocus lens in cooperation with the first grid electrode 61. The third grid electrode (the first anode) 63 is supplied with an anode voltage of 30 kV which is applied the fifth grid electrode (the second anode) 65 serving as a final electrode. In general, the anode voltage of the PRT is equal to or higher than 25 kV.

When the outside neck diameter of the electron beam deflection region is made different from that of the electron beam focusing region, the electron gun is moved farther from the phosphor screen due to mechanical restrictions. Focus characteristics of the electron beam are degraded when the electron gun is moved farther from the phosphor screen, but the degradation of the focus characteristics in the PRT is easily compensated for by raising the anode voltage. In the PRT, it is possible to increase its maximum operating voltage to 30 kV or more.

The fourth grid electrode (the focus electrode) 64 is divided into a first member of the fourth grid electrode (a first member of the focus electrode) 641 and a second member of the fourth grid electrode (a second member of the focus electrode) 642, and both of them are supplied with a focus voltage of about 8 kV. The phosphor-side end of the second member of the focus electrode 642 is enlarged in diameter, and extends into the second anode 65 to form a large-diameter final-stage main lens. The larger the outside neck diameter, the larger the lens diameter and the more effectively improved is the focus characteristics. The center plane of the final-stage main lens is defined as the phosphor-side end ML of the second member 642 of the focus electrode, and the axial distance L2 from the center plane ML of the final-stage main lens to the center of the inner surface of the panel 1 is 139.7 mm.

The PRT is required to produce high-brightness images, and therefore is operated at the beam current (the cathode current) of 4 mA or more. It is very important to secure a large lens diameter for retaining high-quality focus even at such a large current. Since the PRT is operated at a high phosphor-screen voltage, the beam spread due to space charge repulsion is comparatively small especially at a large beam current, and the diameter of the electron beam spot on the phosphor screen at a large current is approximately determined by the electron beam spread due to spherical aberration of the electron gun. That is to say, in the PRT, the advantages obtained by increasing the lens diameter of the electron gun outweigh the disadvantages caused by making the neck of the different-diameter neck portions and moving the electron gun farther from the phosphor screen.

A shield cup 66 is assembled integrally with the second anode 65 and serves as one of the electrodes forming the main lens. The diameters of the shield cup 66 are made gradually smaller toward the phosphor screen 100. As the outside diameters of the neck junction region 33 become smaller in the vicinity of the front end of the electron gun 6, the diameters of the electrodes of the electron gun 6 is made smaller in the vicinity of the front end of the electron gun 6 so as to eliminate the need of moving the electron gun 6 excessively farther from the phosphor screen 100.

In the case of the single-electron-beam type PRT, special consideration does not need to be given to striking of the inner wall of the neck by the two side electron beams, unlike in the case of three in-line electron beam shadow mask type color cathode ray tubes. In the PRT employing a projection type CRT of the different-diameter multiple neck type (hereinafter PRT of the different-diameter multiple neck type) in accordance with the present invention, the difference in diameter between the large-diameter neck portion 32 and the small-diameter neck portion 31 is made as great as possible to achieve the reduction of the deflection power consumption and the enlargement of the lens diameter of the main lens, which are usually incompatible with each other, at the same time as described above, and it is very effective to select the difference to be 5 mm or more.

To achieve the two conflicting desires for the reduction of the deflection power consumption and the enlargement of the main lens diameter, it is preferable that (1) 20 mm≦the outside diameter of the small-diameter neck portion≦30 mm for obtaining a significant amount of reduction of the deflection power consumption,
(2) 29.1 mm≦the outside diameter of the large-diameter neck portion, for securing the required focus characteristics without increasing the overall length of the PRT excessively (the improvement in the focus characteristics is more pronounced when the outside diameter of the large-diameter neck portion≧36.5 mm), and
(3) 5.0 mm≦the difference in outside diameter between the large- and small-diameter neck portions≦16.5 mm in view of the physical strength and others.

The neck junction region 33 connecting the large-diameter neck portion 32 and the small-diameter neck portion 31 together varies gradually in diameter along the axis of the cathode ray tube, and therefore, as the difference in diameter between the large-diameter neck portion 32 and the small-diameter neck portion 31 is increased, the axial length of the neck junction region 33 is increased. In the above-explained case where the diameters of the large-diameter neck portion 32 and the small-diameter neck portion 31 are 36.5 mm and 29.1 mm, respectively, the axial length of the neck junction region 33 is approximately 8 mm. The space around the neck junction region 33 was not used.

The PRT is provided with a convergence yoke 8, a velocity modulation coil 9, centering magnets 10, 11 in the order from the deflection yoke 7 toward the base 4. The deflection yoke 7 includes the horizontal deflection coil 71 for scanning an electron beam in a horizontal direction, the vertical deflection coil 72 for scanning the electron beam in a vertical direction, and a coil separator 73 for positioning the horizontal and vertical deflection coils 71, 72 separately in place. The base 4 side end of the deflection yoke 7 (the vicinity of the center of deflection) is mounted around the small-diameter neck portion 31.

The convergence yoke 8 includes an annular magnetically permeable core 801 and a toroidal coil 802 toroidally wound about the core 801 for generating convergence magnetic fields. The convergence yoke 8 extends from the large-diameter neck portion 32 to surround at least a portion (for example, 2 to 3 mm in an axial direction) of the neck junction region 33, and is fitted into convergence yoke holders attached to the base 4 side end of the coil separator 73 of the deflection yoke 7. The reason that the base 4 side end of the convergence yoke 8 is mounted on the large-diameter neck portion 32 is avoidance of excessive increases of both the distance L2 from the position ML of the final-stage main lens of the electron gun to the center of the phosphor screen and the overall length L1 of the PRT due to the extension of the small-diameter neck portion 31 toward the base 4.

The inner wall of the convergence yoke 8 is approximately cylindrical along its entire axial length with a radius corresponding to the diameter of the large-diameter neck portion 32. This is because the convergence yoke 8 is fitted around the large-diameter neck portion 32 from the base 4. Although the inner diameter of the convergence yoke 8 around the neck junction region 33 is equal to its inner diameter around the large-diameter neck portion 32, the efficiency of correction of color misregistration is improved without mounting the convergence yoke 8 around the small-diameter neck portion 31, because the overall length of the convergence yoke 8 is increased by utilizing the space around the neck junction region 33 which has never been used.

Incidentally, it is conceivable to extend the overall length of the convergence yoke 8 toward the base 4 for the purpose of improving the efficiency of correction of color misregistration. However, since neck-mounted components such the velocity modulation coil 9 and the centering magnets 10, 11 are fixed on the base 4 side of the convergence yoke 8 via a neck-mounted component holder 13 by using a clamp 12*m*, consideration needs to be given to prevent interference of the convergence yoke 8 with the neck-mounted components. There is also possibility that the axial center position CY of the coil 801 of the convergence yoke 8 is displaced from the position ML of the final-stage main lens of the electron gun excessively toward the base 4 and focus characteristics of the electron beam are adversely effected. Consequently, it is preferable that the axial center position CY of the coil 801 of the convergence yoke 8 is positioned on the phosphor screen side of the final-stage main lens position ML.

The velocity modulation coil 9 is employed to improve the image display ratio. Since the velocity modulation coil 9 is mounted around the large-diameter neck portion 32 of 36.5 mm in outside diameter, its sensitivity is important. To improve the sensitivity of the velocity modulation coil 9, the focus electrode 64 is divided into the first member of the focus electrode 641 and the second member 642 of the focus electrode, thereby to form a gap therebetween, and consequently, the magnetic field generated by the velocity modulation coil 9 is effectively exerted on the electron beam.

Figure 2:
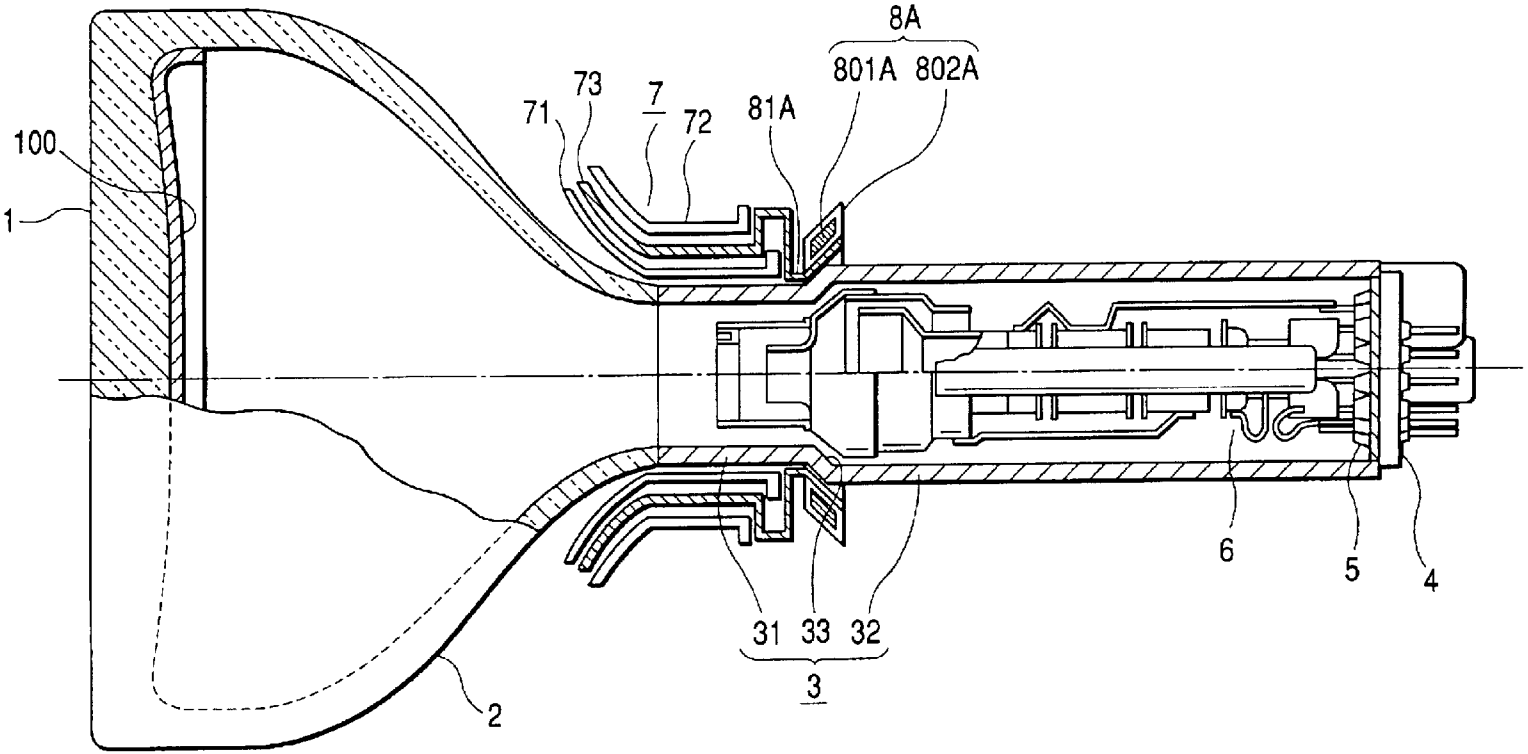
FIG. 2 is a schematic side view, partly cut away and partly in section of a second embodiment of a projection type cathode ray tube device in accordance with the present invention.
Figure 3A:
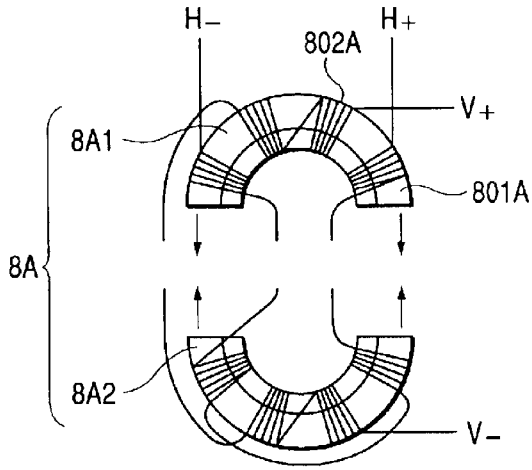
FIGS. 3A and 3B are schematic front views of a convergence yoke of FIG. 2 as viewed from a phosphor screen side for explaining a method of assembling the convergence yoke.
Figure 3B:
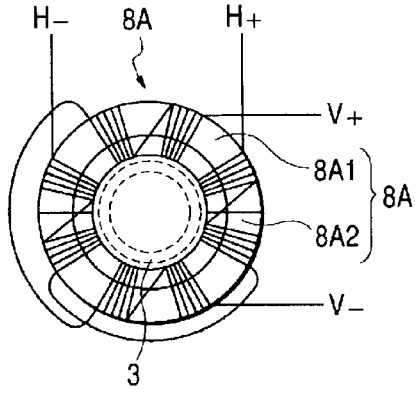

FIG. 2 is a schematic side view, partly cut away and partly in section of a second embodiment of the PRT in accordance with the present invention, and FIGS. 3A and 3B are schematic front views of a convergence yoke of FIG. 2 as viewed from the phosphor screen 100 side of FIG. 2 for explaining a method of assembling the convergence yoke 8A. The convergence yoke 8A is disposed around the neck junction region 33, and the its inner wall is of the shape of the generally truncated cone conforming substantially to the contour of the outer surface of the neck junction region 33. The convergence yoke 8A includes an annular magnetically permeable core 801A and a toroidal coil 802A toroidally wound about the core 801A for generating convergence magnetic fields. A convergence yoke holder 81A for holding the convergence yoke 8A in place has a portion conforming substantially to the contour of the outer surface of the neck junction region 33. The inner diameters of the convergence yoke 8A (the inner diameters of the annular core 801A) is gradually reduced from its stem 5 side end toward its phosphor screen 100 side end, and therefore the efficiency of correction of the electron beam is improved.

Since the inside diameter of the convergence yoke 8A on its phosphor screen side end is smaller than the outside diameter of the large-diameter neck portion 32, the convergence yoke 8A is divided into an upper member 8A1 and a lower member 8A2 as shown in FIG. 3A. Each of the upper member 8A1 and the lower member 8A2 is composed of a semi-annular magnetically permeable core 801A and a toroidal coil 802A toroidally wound about the core 801A for generating convergence magnetic fields. The upper member 8A1 and the lower member 8A2 are held together to sandwich the neck 3 (indicated by broken lines) vertically as shown in FIG. 3B.

Figure 4:
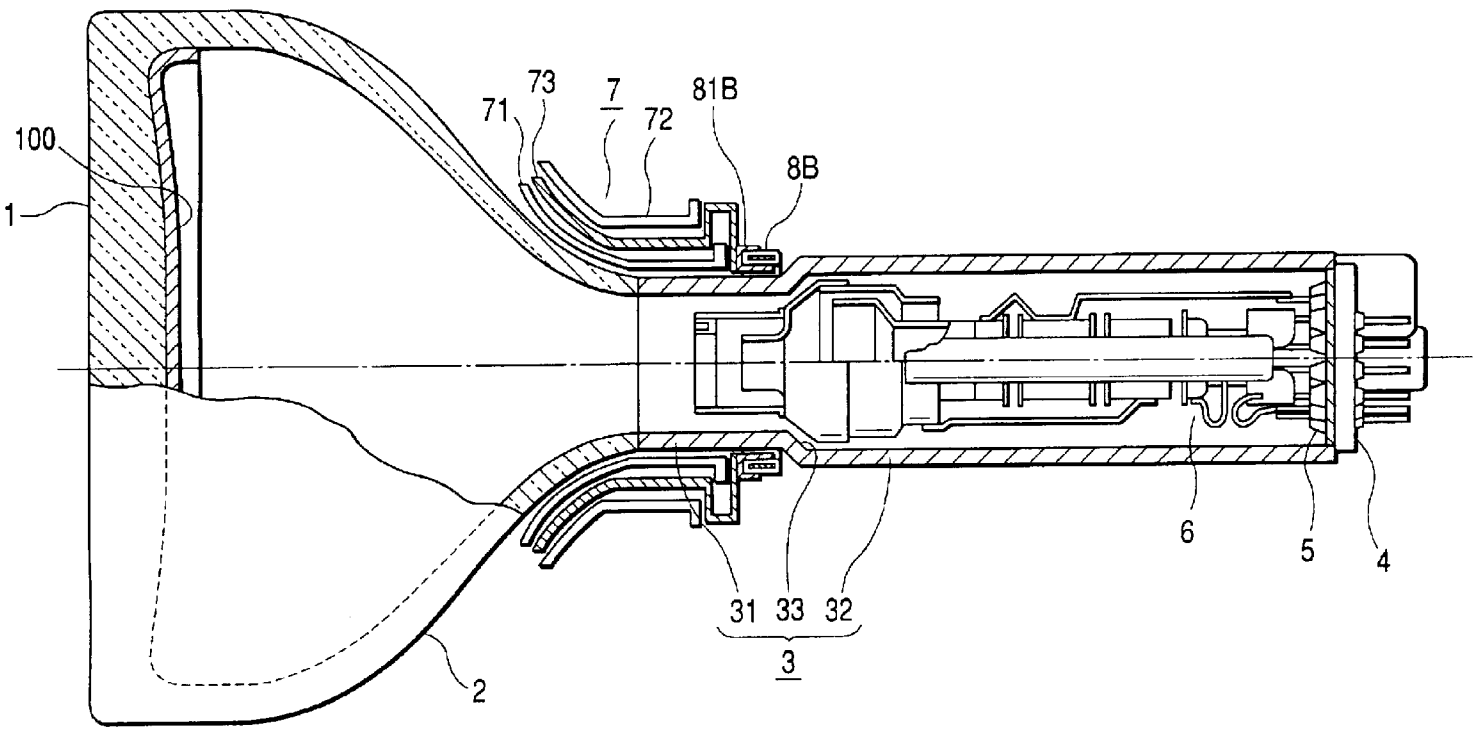
FIG. 4 is a schematic side view, partly cut away and partly in section of a third embodiment of a projection type cathode ray tube device in accordance with the present invention.
Figure 5A:
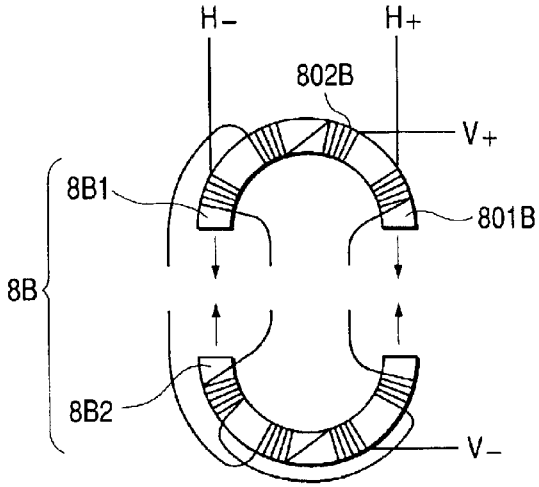
FIGS. 5A and 5B are schematic front views of a convergence yoke of FIG. 4 as viewed from a phosphor screen side for explaining a method of assembling the convergence yoke.
Figure 5B:
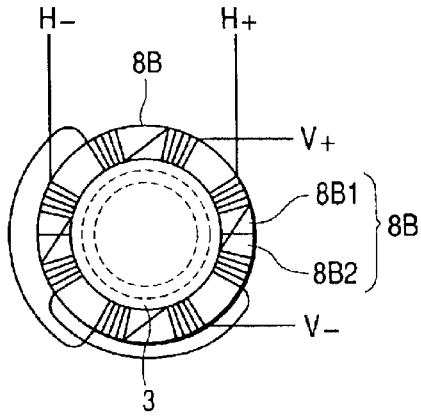

FIG. 4 is a schematic side view, partly cut away and partly in section of a third embodiment of the PRT in accordance with the present invention, and FIGS. 5A and 5B are schematic front views of a convergence yoke 8B of FIG. 4 as viewed from the phosphor screen 100 side of FIG. 4 for explaining a method of assembling the convergence yoke 8B. The convergence yoke 8B is disposed around the small-diameter neck portion 31, and the its inner wall is of the generally cylindrical shape conforming substantially to the contour of the outer surface of the small-diameter neck portion region 31. The convergence yoke 8B includes an annular magnetically permeable core 801B and a toroidal coil 802B toroidally wound about the core 801B for generating convergence magnetic fields. A convergence yoke holder 81B for holding the convergence yoke 8B in place has a portion conforming substantially to the contour of the outer surface of the small-diameter neck portion 31.

The convergence yoke holder 81B is placed closer toward the axis of the cathode ray tube than the convergence yoke holder 81 explained in connection with FIG. 1 is toward the tube axis. The inner diameter of the convergence yoke 8B (the inner diameter of the core 801B) is smaller than that of the convergence yoke 8, and consequently, the sensitivity of correction exerted on the electron beam is further improved.

Since the inside diameter of the convergence yoke 8B is smaller than the outside diameter of the large-diameter neck portion 32, the convergence yoke 8B is divided into an upper member 8B1 and a lower member 8B2 as shown in FIG. 5A. Each of the upper member 8B1 and the lower member 8B2 is composed of a semi-annular magnetically permeable core 801B and a toroidal coil 802B toroidally wound about the core 801B for generating convergence magnetic fields. The upper member 8B1 and the lower member 8B2 are held together to sandwich the neck 3 (indicated by broken lines) vertically, as shown in FIG. 5B.

In this embodiment, it is more effective to choose the outside diameter of the large-diameter neck portion 32 to be 36.5 mm or more, and the outside diameter of the small-diameter neck portion 31 to 29.1 mm or less. Reduction in the outside diameter of the small-diameter neck portion 31 makes it possible to shorten the axial overall length of the deflection coil of the deflection yoke 7, and consequently, a sufficient space for disposing the convergence yoke 8B is secured by suppressing the extension of the length of the small-diameter neck portion 31. Further, integral assembly of the deflection yoke 7 and the convergence yoke 8 can be realized easily.

Figure 6:
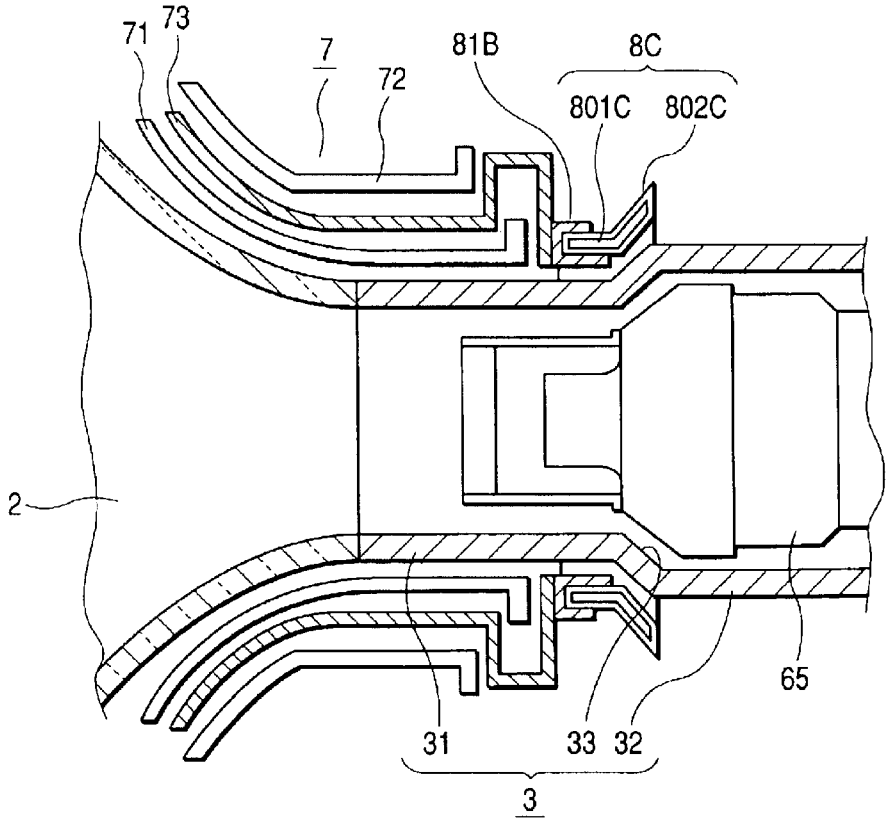
FIG. 6 is a schematic fragmentary side view, partly cut away and partly in section of a modification of the convergence yoke used for a projection type cathode ray tube device in accordance with the present invention.

FIG. 6 is a schematic fragmentary cross-sectional view of a modification of the convergence yoke for use in the PRT in accordance with the present invention. The modification 8C of the convergence yoke is a combination of the second embodiment and the third embodiment explained in connection with FIG. 2 and FIG. 4, respectively, the convergence yoke 8C includes an annular magnetically permeable core 801C and a toroidal coil 802C toroidally wound about the core 801C for generating convergence magnetic fields, and consequently, the efficiency of correction exerted on the electron beam is further improved.

Figure 7:
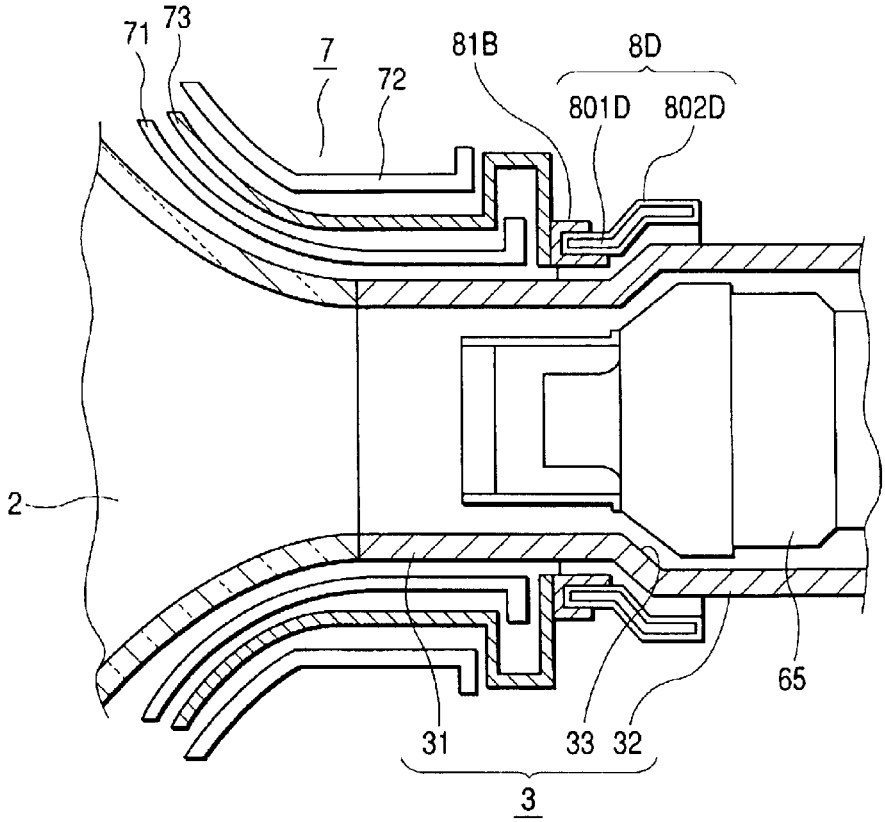
FIG. 7 is a schematic fragmentary side view, partly cut away and partly in section of another modification of the convergence yoke used for a projection type cathode ray tube device in accordance with the present invention.

FIG. 7 is a schematic fragmentary cross-sectional view of another modification of the convergence yoke for use in the PRT in accordance with the present invention. In this modification 8D of the convergence yoke, a generally cylindrical portion having its inner wall conforming substantially to the contour of the outer surface of the large-diameter neck portion 32 is added to the modification 8C explained in connection with FIG. 6, the convergence yoke 8D includes an annular magnetically permeable core 801D and a toroidal coil 802D toroidally wound about the core 801D for generating convergence magnetic fields, and consequently, the efficiency of correction exerted on the electron beam is further improved.

Figure 8:
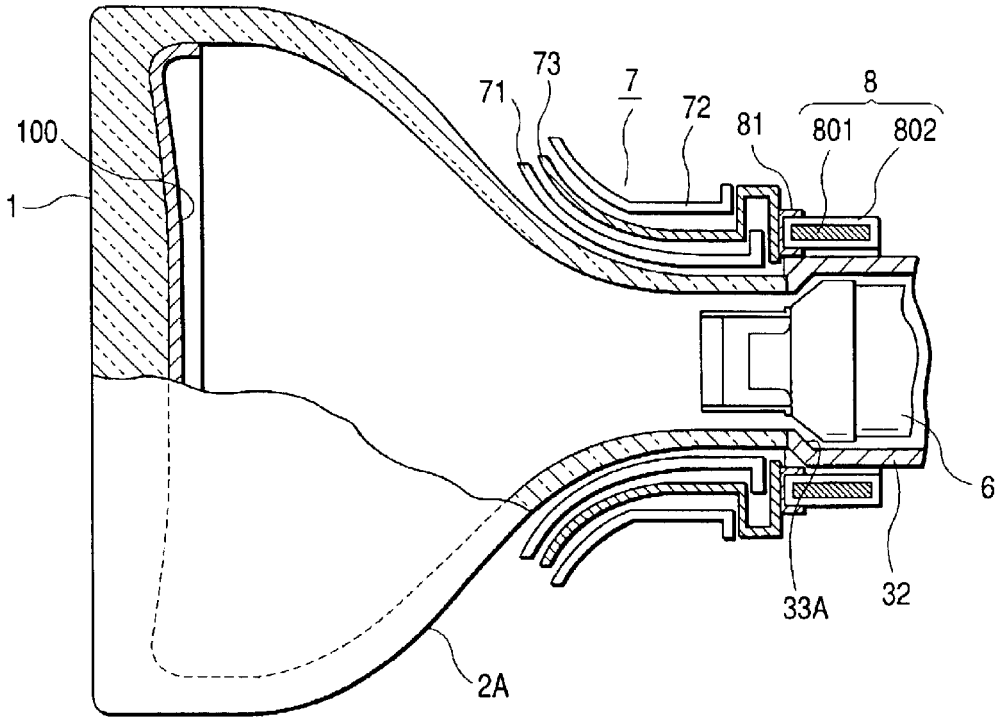
FIG. 8 is a schematic fragmentary side view, partly cut away and partly in section of another embodiment of a projection type cathode ray tube device in accordance with the present invention.

In the above-explained embodiments, the neck 3 is composed of the small-diameter neck portion 31, the large-diameter neck portion 32, and the neck junction region 33 for coupling the small-diameter neck portion 31 and the large-diameter neck portion 32 together. However, in another embodiment illustrated in FIG. 8, the funnel 2A and the large-diameter neck portion 32 are coupled together via the neck junction region (the diameter-reducing region) 33A without employing the small-diameter neck portion 31. In this embodiment, the electron-gun 6 side end of the funnel 2A extends and tapers down to a small-diameter end of the diameter-reducing region 33A. The deflection yoke 7 is slightly modified to match the funnel 2A. This embodiment is applicable to all of the above-explained embodiments and modifications, and provides the advantages similar to those obtained by the above-explained embodiments and modifications.

In this embodiment, it is preferable that (1) 20 mm≦the outside diameter of the small-diameter end of the diameter-reducing region 33A≦30 mm for obtaining a significant amount of reduction of the deflection power consumption, (2) 29.1 mm≦the outside diameter of the large-diameter neck portion, for securing the required focus characteristics without increasing the overall length of the PRT excessively (the improvement in the focus characteristics is more pronounced when the outside diameter of the large-diameter neck portion≧36.5 mm), and (3) 5.0 mm≦the difference in outside diameter between the large-diameter neck portion and the small-diameter end of the diameter-reducing region 33A≦16.5 mm in view of the physical strength and others.

Figure 9:
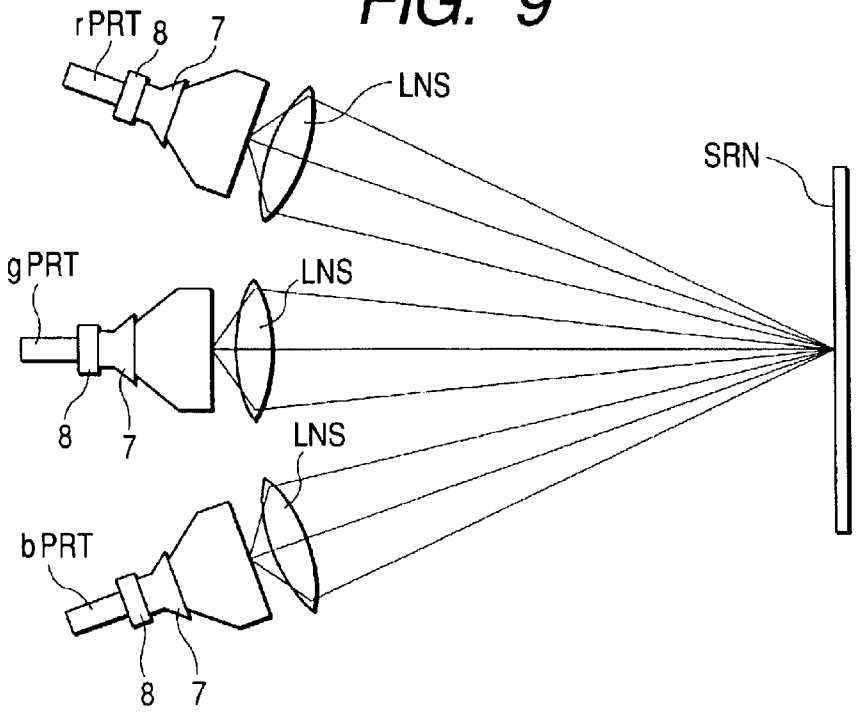
FIG. 9 is a schematic illustrating a concept of a projection TV receiver system.

FIG. 9 is a schematic illustrating a concept of the projection TV system. In the projection TV receiver, as shown in FIG. 9, three color images from a PRT for red color rPRT, a PRT for green color gPRT, and a PRT for blue color, respectively, are projected onto a screen SRN via projection lenses LNS to provide converged images on the screen SRN. Rough adjustment of convergence of the three images are made by tilting the respective PRTs, and fine adjustment of the convergence is made by using the convergence yokes 8 mounted on the respective PRTs.

FIG. 11 illustrates some examples of currents supplied to the convergence yokes 8 to correct distortions of the rasters projected on the screen SRN by the gPRT, rPRT and bPRT.

Figure 10:
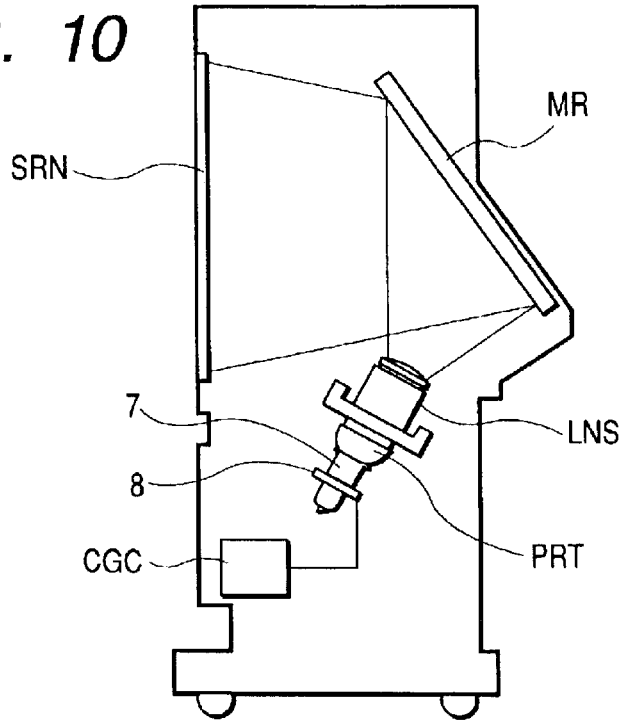
FIG. 10 is a schematic cross-sectional view of a rear projection type TV receiver.

FIG. 10 is a schematic cross-sectional view of a rear projection type TV receiver. Images from the PRTs are enlarged by the lenses LNS, then are reflected by a mirror MR, and then are projected onto the screen SRN. The convergence yokes 8 incorporated in the PRTs are connected to a convergence drive circuit CGC. The improvement in the sensitivity of correction of the color misregistration by the convergence yokes 8 in the PRTs of the present invention reduces power consumption in the convergence drive circuit CGC. With this configuration, standard deflection circuit systems for cathode ray tubes having a neck of 29.1 mm in diameter tube, and focus characteristics are also improved.

Since the projection TV receivers employs three PRTs, the amount of deflection power savings and the amount of improvement of efficiency of misconvergence correction are triple those in the case of usual TV receivers. Usual projection TV receivers employ a viewing screen having a diagonal dimension equal to 40 inches or more. When normal NTSC signals are displayed on such a large viewing screen, the scanning-line structure is very visible, and therefore the display quality is degraded. To eliminate this problem, the projection TVs often adopt the Advanced Television System employing a larger number of scanning lines. In this case, the number of the scanning lines is in a range of from two to three times that in the case of the normal NTSC system, and therefore the deflection power consumption is increased. In the Advanced Television System, precise correction of color misregistration is required. Consequently, the employment of the PRT in accordance with the present invention is very effective for the reduction of the deflection power consumption and improvement of efficiency of correction of misconvergence in the projection TV receivers. The present invention is not only applicable to the projection TV receivers, but is also equally applicable to general projectors employing three PRTs.

As explained above, the representative configurations of the present invention improve focus characteristics and efficiency of correction of color misregistration in the PRT of the different-diameter multiple neck type.

What is claimed is:

1. A projection type cathode ray tube device comprising:

a glass envelope including a panel, a neck, a funnel connecting said panel to an end of said neck, and a stem closing another end of said neck;

a phosphor screen formed on an inner surface of said panel;

an electron gun housed in said neck for projecting an electron beam toward said phosphor screen;

a deflection yoke for scanning said electron beam on said phosphor screen; and a convergence yoke for generating a beam-convergence magnetic field, wherein said neck comprises a small-diameter neck portion disposed on a side thereof facing toward said funnel, a large-diameter neck portion disposed on a side thereof facing toward said stem, and a neck junction region connecting said small-diameter neck portion and said large-diameter neck portion;

said deflection yoke is disposed in a vicinity of a transition region between said funnel and said small-diameter neck portion, and said convergence yoke is disposed to extend from said large-diameter neck portion and surround at least a portion of said neck junction region.

2. A projection type cathode ray tube device according to claim 1, wherein a portion of said convergence yoke surrounding said at least a portion of said neck junction region is equal in inside diameter to a portion of said convergence yoke surrounding said large-diameter neck portion.

3. A projection type cathode ray tube device according to claim 1, wherein a center of said convergence yoke in a direction of an axis of said projection type cathode ray tube device is displaced from a phosphor-screen-side end of an electrode immediately preceding a final anode electrode of a final-stage main lens of said electron gun toward said phosphor screen.

4. A projection type cathode ray tube device according to claim 1, wherein said convergence yoke is configured so as to fit into a holder attached to said deflection yoke.

5. A projection type cathode ray tube device according to claim 1, wherein a difference in outside diameter between said large-diameter neck portion and said small-diameter neck portion is in a range of from 5 mm to 16.5 mm.

6. A projection type cathode ray tube device comprising:

a glass envelope including a panel, a neck, a funnel connecting said panel to an end of said neck, and a stem closing another end of said neck;

a phosphor screen formed on an inner surface of said panel;

an electron gun housed in said neck for projecting and focusing an electron beam onto said phosphor screen;

a deflection yoke for scanning said electron beam on said phosphor screen two-dimensionally; and a convergence yoke for generating a beam-convergence magnetic field, wherein said neck comprises a small-diameter neck portion disposed on a side thereof facing toward said funnel, a large-diameter neck portion disposed on a side thereof facing toward said stem, and a neck junction region connecting said small-diameter neck portion and said large-diameter neck portion;

said deflection yoke is disposed in a vicinity of a transition region between said funnel and said small-diameter neck portion, said convergence yoke is disposed around said neck junction region, and an inside diameter at a phosphor-screen-side end of said convergence yoke is smaller than an outside diameter of said large-diameter neck portion.

7. A projection type cathode ray tube device according to claim 6, wherein an inside diameter of said convergence yoke decreases gradually toward said phosphor screen.

8. A projection type cathode ray tube device according to claim 6, wherein said convergence yoke is composed of two halves assembled together.

9. A projection type cathode ray tube device comprising:

a glass envelope including a panel, a neck, a funnel connecting said panel to an end of said neck, and a stem closing another end of said neck;

a phosphor screen formed on an inner surface of said panel;

an electron gun housed in said neck for projecting an electron beam toward said phosphor screen;

a deflection yoke for scanning said electron beam on said phosphor screen; and a convergence yoke for generating a beam-convergence magnetic field, wherein said neck comprises a small-diameter neck portion disposed on a side thereof facing toward said funnel, a large-diameter neck portion disposed on a side thereof facing toward said stem, and a neck junction region connecting said small-diameter neck portion and said large-diameter neck portion;

said deflection yoke is disposed in a vicinity of a transition region between said funnel and said small-diameter neck portion, and said convergence yoke is disposed around said small-diameter neck portion.

10. A projection type cathode ray tube device comprising:

a glass envelope including a panel, a neck, a funnel connecting said panel to an end of said neck, and a stem closing another end of said neck;

a phosphor screen formed on an inner surface of said panel;

an electron gun housed in said neck for projecting an electron beam toward said phosphor screen;

a deflection yoke for scanning said electron beam on said phosphor screen; and a convergence yoke for generating a beam-convergence magnetic field, wherein said neck comprises a large-diameter neck portion disposed on a side thereof facing toward said stem, and a neck junction region having an outside diameter thereof decreasing toward said funnel, one end of said neck junction region being connected to said large-diameter neck portion, and another end of said neck junction region being connected to said funnel, said deflection yoke is disposed in a vicinity of a transition region between said funnel and said neck junction region, and said convergence yoke is disposed to extend from said large-diameter neck portion and surround at least a portion of said neck junction region.

* * * * *